US007997104B2

(12) United States Patent
Gracia Bobed

(10) Patent No.: US 7,997,104 B2
(45) Date of Patent: Aug. 16, 2011

(54) LAUNDRY DRUM

(75) Inventor: Ismael Gracia Bobed, Zaragoza (ES)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 448 days.

(21) Appl. No.: 12/085,073

(22) PCT Filed: Nov. 16, 2006

(86) PCT No.: PCT/EP2006/068555

§ 371 (c)(1),
(2), (4) Date: May 15, 2008

(87) PCT Pub. No.: WO2007/062987

PCT Pub. Date: Jun. 7, 2007

(65) Prior Publication Data

US 2009/0120139 A1 May 14, 2009

(30) Foreign Application Priority Data

Dec. 2, 2005 (ES) ..... 200503075

(51) Int. Cl.
*D06F 37/06* (2006.01)

(52) U.S. Cl. ..... 68/142; 68/24

(58) Field of Classification Search ..... 68/142, 68/24, 139

See application file for complete search history.

(56) References Cited

U.S. PATENT DOCUMENTS

| | | | | |
|---|---|---|---|---|
| 7,287,402 | B2 * | 10/2007 | Ratfisch | 68/142 |
| 7,380,422 | B2 * | 6/2008 | Kim et al. | 68/17 A |
| 7,395,684 | B2 * | 7/2008 | Ozturk | 68/142 |
| 7,444,843 | B2 * | 11/2008 | Ozturk et al. | 68/142 |
| 2004/0123634 | A1 | 7/2004 | Kim et al. | |
| 2004/0129036 | A1 | 7/2004 | Ratfisch | |
| 2005/0097927 | A1 | 5/2005 | Kim et al. | |
| 2005/0155392 | A1 * | 7/2005 | Ozturk | 68/3 R |
| 2005/0204785 | A1 | 9/2005 | Kim et al. | |
| 2005/0252253 | A1 | 11/2005 | Ahn | |
| 2005/0252254 | A1 * | 11/2005 | Kim | 68/142 |

FOREIGN PATENT DOCUMENTS

| | | | |
|---|---|---|---|
| DE | 3317201 | A1 * | 11/1984 |
| EP | 0 245 721 | | 11/1987 |
| GB | 1161219 | | 8/1969 |

OTHER PUBLICATIONS

Electronic translation of DE 3317201 A1, Nov. 1984.*
International Search Report PCT/EP2006/068555, Feb. 20, 2007.
National Search Report ES 2 276 627, Mar. 23, 2007.

* cited by examiner

*Primary Examiner* — Joseph L Perrin
(74) *Attorney, Agent, or Firm* — James E. Howard; Andre Pallapies

(57) ABSTRACT

A laundry drum comprises a drum having a cylindrical band (2), at least two rows of receptacles (4) defined on the cylindrical band (2), said receptacles (4) arranged in a staggered sequence along a central line (6) therebetween; and at least one paddle (3) fastened to the cylindrical band (2) on an inside of said drum by means of two corresponding rows of elastic clips (5) extended from the paddle (5) and being held in said receptacles (4). Such arrangement of the receptacles (4) provide a possible larger area a long the peripheral direction of the receptacles to distribute the stresses formed when the drum spins at a high speed in operation of washing, rinsing or the like.

19 Claims, 2 Drawing Sheets

LAUNDRY DRUM

BACKGROUND OF THE INVENTION

The present invention relates to a laundry drum for a drum-type washing machine, dryer or the like.

The use of rotating drum-type washing machine is generally known. It is conventional in such machines to utilize a number, for example three or four agitating paddles projected inwardly in the inside of the drum to promote the tumbling of articles being laundered during the washing and rinsing operation. Great Britain Pat. No. 1,161,219 A issued to Philips Electronic on Aug. 13, 1969 exemplifies a plastic rib of substantially triangular cross-section with closed ends so as to be in the form of a trough fastened to the inside of the drum by means of projections extended from the edge of the trough and being held in two rows of co-operating keyhole slots in the wall of the drum. The keyhole slots are in a mirrored arrangement with respect to a central line between the two rows of the slots. The problem with this arrangement of slots is that it will weaken excessively the wall of the drum, because operational stress within the wall of the drum cannot be distributed into regions between mirrored pairs of slots, thus causing inequalities in stress distribution. On that way stresses are unevenly distributed and failure by breakage may occur when working at a high spinning speed (e.g. 1500 rpm) during washing, rinsing or the like operation.

Moreover, the rib being secured to the cylindrical wall of the drum by the projections provided on the edges of the trough engaging with the co-operating keyhole slots in the wall, obviously another fastening element such as a screw as described in the prior art must be necessary for retaining the rib in position after being engaged with the wall on the ground that the projections will gradually deform plastically subjected to forces exerted from the engagement between the projections and slots and as a result may slide out of the slots over a long period of time.

BRIEF SUMMARY OF THE INVENTION

Accordingly, one of the objectives of the present invention is to provide an improved laundry drum for a drum-type machine that provides a possible larger area along the peripheral direction of the drum to distribute the stresses originated when the drum spins at a high speed so as to avoid the deformation of the drum.

Yet another aim of the present invention is to provide an improved laundry drum, in which the receptacles can secure and retain the clips of the paddle in position respectively, even without the help of the fastening elements such as securing screws, rivets, etc.

According to the present invention, the above-mentioned aims are achieved by an improved laundry drum comprising a drum having a cylindrical band, at least two rows of receptacles defined on the cylindrical band, said receptacles arranged in a staggered sequence along a central line therebetween; and at least one paddle fastened to the cylindrical band on an inside of said drum by means of two corresponding rows of elastic clips extended from the paddle and being held in said receptacles. Such arrangement of the receptacles provides a larger area along the peripheral direction of the drum to distribute the stresses formed when the drum spins at a high speed in operation of washing, rinsing or the like.

According to a further feature of the present invention, each receptacle defined in the cylindrical band comprises a protrusion forming an inclination portion and a holding portion. When the paddle is assembled onto the drum, the clips of the paddle slide along the inclination portion and are securely held in the holding portion of the receptacles, respectively. Each of the protrusions preferably includes a cross-section of a triangle for forming the inclination portion and a rectangle for forming the holding portion together with the other side wall of the receptacle so as to secure the paddle permanent in the holding portion and prevent the paddle from moving back or disassembling.

According to a further feature of the present invention, the corresponding two rows of clips extended from the paddle have rotational symmetry, which provides an easy way to assemble the paddle to the drum in both senses in spite of the asymmetry of the receptacles.

BRIEF DESCRIPTION OF THE DRAWINGS

Other objects, advantages and novel features of the invention will become apparent from the following detailed description of a preferred embodiment when taken in conjunction with the accompanying drawings.

DETAILED DESCRIPTION OF THE INVENTION

Figure 1:
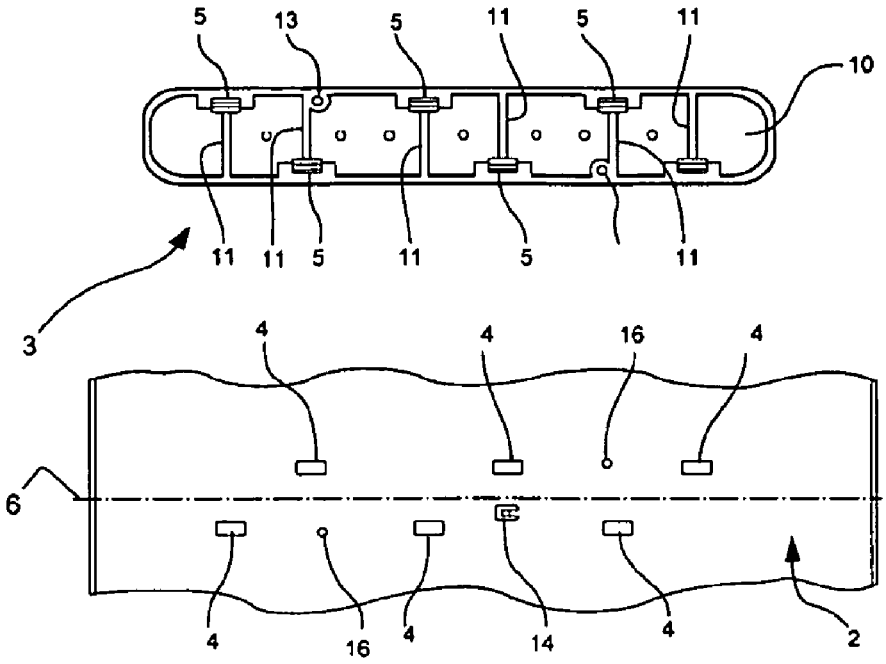
FIG. 1 is a general perspective view of a paddle and the portion of the laundry drum to which it is to be secured.

Referring to FIG. 1, a laundry drum 1 for a drum-type washing machine, dryer or the like comprises a cylindrical band 2 and at least one paddle 3 fastened on an inside of the drum 1. At least two rows of receptacles 4 are defined on said band 2 for correspondingly receiving two rows of clips 5 extended from the paddle 3. Said receptacles 4 are arranged in a staggered sequence along a central line 6 between the two rows breaking with the symmetry of the receptacles 4, as a consequence, providing a relative larger area around to distribute the forces when the drum is spinning at a high speed during washing, rinsing or the like operation. In the present embodiment, the central line 6 is parallel to the rotating axis of the drum 1, equal numbers of receptacles are defined on both sides of the central line 6. Alternatively, the central line 6 may not be parallel to the rotating axis of the drum, different number of receptacles may be defined on both sides of the central line 6, provided that the receptacles 3 defined on the band 2 can meet the requirements of mechanical property to hold the paddle 3 securely on the band 2.

Figure 3:
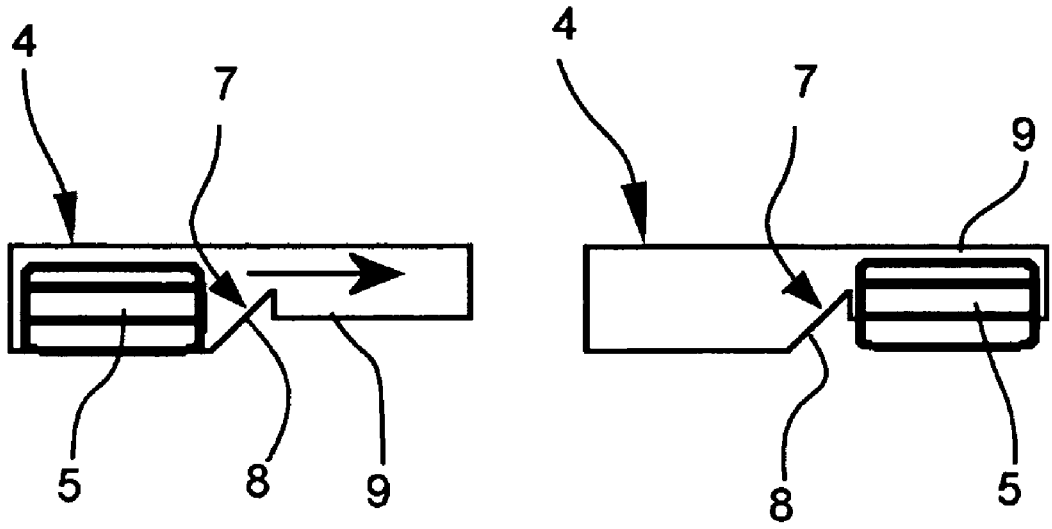
FIG. 3 illustrates an assembly process of a clip of the paddle before clipping and clipped.

By referring to FIG. 3, each of the receptacles 4 further comprise a protrusion 7 projecting inwardly in each of the receptacles 4, separating each of the receptacles 4 into an inclination portion 8 and a holding portion 9. Said protrusion 7 includes a cross-section of a triangle forming the inclination portion 8 and a rectangle forming the holding portion 9 together with the other side walls of each of the receptacles 4. When the paddle 3 is assembled onto the drum 1, the clips 5 of the paddle 3 slide along the inclination portion 8 and eventually are held at the holding portion 9. Preferably the inclination portion 8 has an angle at substantially 45 degrees. A junction of the holding portion 9 and the inclination portion 8 has an angle at 90 degrees, which provides that this engagement between the clips 5 and the holding portion 9 of the corresponding receptacle 4 is of a permanent type and with no substantial freedom of movement.

As shown in FIG. 1, the two rows of clips 5 extended from the paddle 3 preferably have rotational symmetry, which provides that the worker has a great facility of assembly since the paddle 3 can be assembled in both senses in spite of the asymmetry of the receptacles 4 of the cylindrical band 2.

Figure 2:
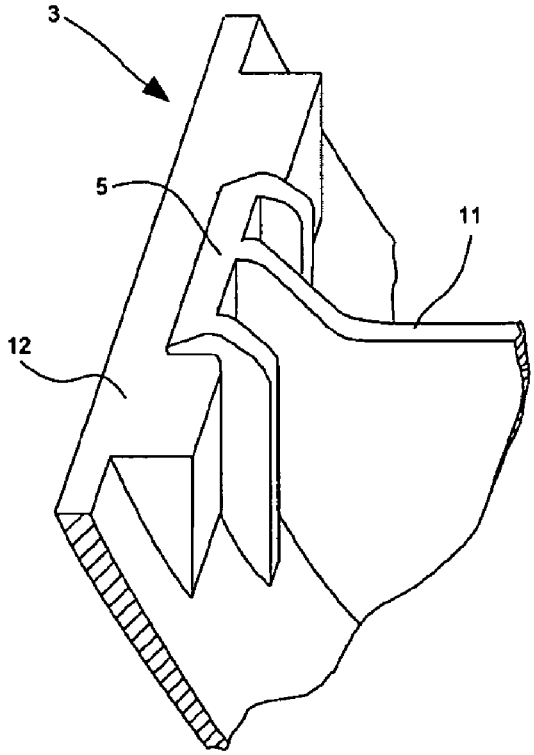
FIG. 2 illustrates a detailed perspective view of a clip from the paddle as shown in FIG. 1.

The paddle 3 as shown in FIGS. 1 and 2 further comprises a hollow body 10 being open toward the cylindrical band 2 at the region where the paddle 3 is secured, a plurality of parallel interior ribs 11 locate in the hollow body 10 to increase the rigidity of the paddle 3, one end of each of the interior ribs 11 having a protrusion base 12 extended from an inside of the paddle 3. When the paddle 3 is assembled together with the drum 1, the receptacles 4 will be covered by the protrusion base 12 respectively. Preferably, at least a threaded hole 13 is disposed at one end being opposite to the protrusion base 12 of the interior ribs 11 to lodge a fastening element such as a screw through a corresponding hole 16 in the cylindrical band 2 for a better fixing of the paddle 3 to the cylindrical band 2. Also, at least one tab 14 extends inwardly along one row of the two rows of receptacles 4 to engage with one of the interior ribs 11 for preventing the paddle 2 from moving back after being assembled.

Figure 4:
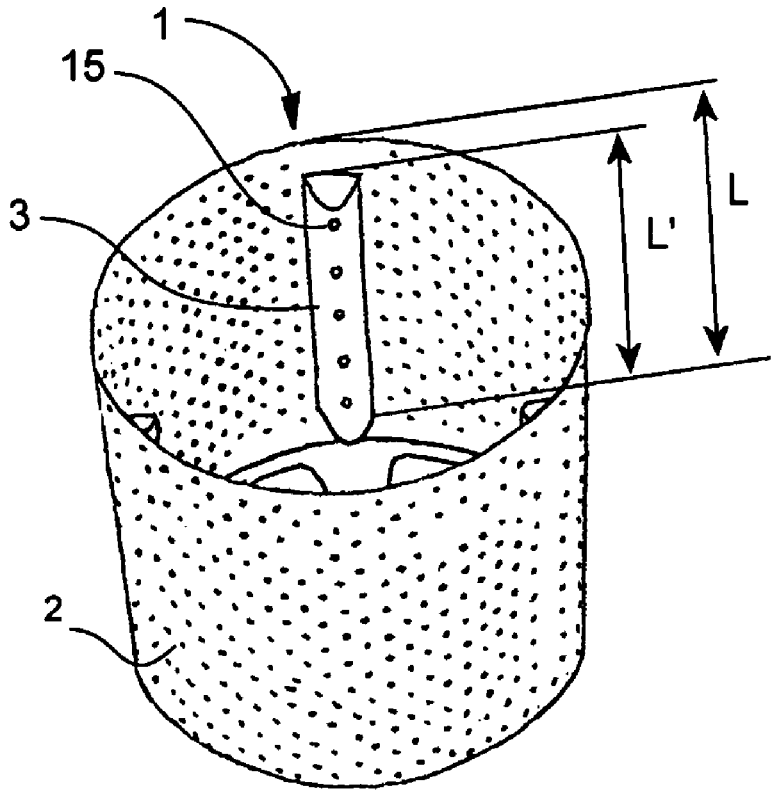
FIG. 4 is a perspective view of the paddle assembly.

Furthermore, to form a better so-called "rain effect", which means that after being lead upward by the paddle 3, the water falls down better in a manner like a shower to moisten the articles in laundry, a plurality of leaks 15 are disposed on an upper side 17 of the paddle 3 as shown in FIG. 4.

Also as shown in FIG. 4, the overall length L' of the paddle 3 is made shorter than the distance L between two circular end walls of the drum 1 so that trapping of the articles being laundered is obviated.

It is to be understood that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

The invention claimed is:

1. A laundry drum, comprising:

a cylindrical band;

at least two rows of receptacles on the cylindrical band, the receptacles arranged in a staggered sequence along a central line between the at least two rows of receptacles;

at least one paddle fastened to the cylindrical band on an inside of the laundry drum by two rows of elastic clips extending from the at least one paddle and being held in said receptacles; and a protrusion extending inwardly in each of the receptacles, the protrusion forming an inclination portion for sliding the elastic clips and a holding portion for securing the elastic clips, wherein a junction between the inclination portion and the holding portion has an angle that secures the clips in the holding portion.

2. The laundry drum according to claim 1, wherein the central line is substantially parallel to a rotational axis of the laundry drum.

3. The laundry drum according to claim 1, wherein the protrusion includes a substantially triangular and rectangular shaped cross-section.

4. The laundry drum according to claim 1, wherein the two rows of elastic clips have rotational symmetry.

5. The laundry drum according to claim 1, wherein the at least one paddle further includes:

a hollow body open toward the cylindrical band in a region where the at least one paddle is fastened;

a plurality of interior ribs located inside of the hollow body;

one end of each of the plurality of interior ribs ending with a protrusion base extending from an inside of the at least one paddle.

6. The laundry drum according to claim 5, further including at least one threaded hole at one end of one of the plurality of interior ribs and a corresponding hole on said cylindrical band;

the hole in the one of the plurality of interior ribs and the hole on the band receiving a screw.

7. The laundry drum according to claim 5, further including a tab extending inwardly from the cylindrical band for engaging with one of the plurality of interior ribs.

8. The laundry drum according to claim 1, further including a plurality of leaks on an upper side of the at least one paddle for enabling a rain effect.

9. The laundry drum according to claim 1, wherein the laundry drum includes two circular end walls;

the overall length of the at least one paddle being less than a distance between two circular end walls of the laundry drum.

10. The laundry drum according to claim 1, wherein the at least one paddle is made of plastic.

11. The laundry drum according to claim 1, wherein the inclination portion includes a substantially triangular shaped cross-section, and wherein the holding portion includes a substantially rectangular shaped cross-section.

12. The laundry drum according to claim 11, wherein, when the at least one paddle is assembled with the cylindrical band, each of the elastic clips is guided by the inclination portion into the holding portion and permanently secured in the holding portion of the protrusion of the receptacle.

13. The laundry drum according to claim 1, wherein the junction between the inclination portion and the holding portion is 90 degrees such that the elastic clips are engaged with the holding portion.

14. The laundry drum according to claim 1, wherein the elastic clips extend from interior ribs of the at least one paddle.

15. A laundry drum, comprising:

a cylindrical band;

two rows of receptacles on the cylindrical band, wherein the two rows of receptacles are arranged in a staggered sequence along a central line between the at least two rows of receptacles, wherein a protrusion extends inwardly in each of the receptacles, the protrusion forming an inclination portion and a holding portion; and a paddle fastened to the cylindrical band on an inside of the laundry drum, wherein the paddle has a hollow body, wherein the hollow body includes two rows of elastic clips extending away from interior ribs of the paddle, wherein each of the elastic clips is guided by the inclination portion into the holding portion and permanently secured in the holding portion of the protrusion of the receptacle, and wherein a junction between the inclination portion and the holding portion has an angle that secures the clips in the holding portion.

16. The laundry drum according to claim 15, wherein the inclination portion includes a substantially triangular shaped cross-section, and wherein the holding portion includes a substantially rectangular shaped cross-section.

17. The laundry drum according to claim 15, wherein the paddle further comprises:

a plurality of interior ribs located inside the hollow body, wherein a protrusion base extends away from an inside of the paddle at one end of each of the plurality of interior ribs.

18. The laundry drum according to claim 17, further comprising:

a tab extending inwardly from the cylindrical band and engaging with one of the plurality of interior ribs.

19. The laundry drum according to claim 15, wherein the junction between the inclination portion and the holding portion is 90 degrees such that the elastic clips are engaged with the holding portion.

* * * * *